US009770756B2

(12) United States Patent
Zhang et al.

(10) Patent No.: US 9,770,756 B2
(45) Date of Patent: Sep. 26, 2017

(54) METHOD AND DEVICE FOR CLEANING A SURFACE OF A TWIN-ROLLER CONTINUOUS THIN STRIP CASTING ROLLER

(71) Applicant: BAOSHAN IRON & STEEL CO., LTD., Shanghai (CN)

(72) Inventors: Jian Zhang, Shanghai (CN); Yuan Fang, Shanghai (CN); Changhong Ye, Shanghai (CN); Chengquan Wang, Shanghai (CN); Junbao Zhang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 134 days.

(21) Appl. No.: 14/429,735

(22) PCT Filed: Sep. 27, 2012

(86) PCT No.: PCT/CN2012/001313

§ 371 (c)(1),
(2) Date: Mar. 19, 2015

(87) PCT Pub. No.: WO2014/047746

PCT Pub. Date: Apr. 3, 2014

(65) Prior Publication Data

US 2015/0231693 A1 Aug. 20, 2015

(51) Int. Cl.

| | |
|---|---|
| ***B22D 11/06*** | (2006.01) |
| ***B22D 11/16*** | (2006.01) |
| ***B22D 43/00*** | (2006.01) |

(52) U.S. Cl.

CPC ..... *B22D 11/0665* (2013.01); *B22D 11/0622* (2013.01); *B22D 11/16* (2013.01); *B22D 43/00* (2013.01)

(58) Field of Classification Search

CPC . B22D 11/06; B22D 11/0622; B22D 11/0665; B22D 11/16; B22D 43/00

(Continued)

(56) References Cited

U.S. PATENT DOCUMENTS

| | | | | |
|---|---|---|---|---|
| 4,793,400 A * | 12/1988 | Wood | B22D 11/0674 | 164/121 |
| 6,886,623 B2 * | 5/2005 | Kato | B22D 11/0674 | 15/256.52 |
| 2010/0236747 A1 * | 9/2010 | Otsuka | B22D 11/0622 | 164/463 |

FOREIGN PATENT DOCUMENTS

| | | |
|---|---|---|
| CN | 201136046 | 10/2008 |
| CN | 102950276 | 3/2013 |

(Continued)

OTHER PUBLICATIONS

Abstract of CN 101041176 A, publication date Sep. 26, 2007.*

*Primary Examiner* — Kevin P Kerns
(74) *Attorney, Agent, or Firm* — Eversheds Sutherland (US) LLP

(57) ABSTRACT

A method for cleaning a surface of a twin-roller continuous thin strip casting roller, each casting roller of a twin-roller continuous thin strip casting machine using two brush rollers arranged at a top and bottom for cleaning the surface, wherein a rotational direction of one brush roller is the same as the casting roller, a linear speed of the casting roller is constant and greater than a rotational speed of the casting roller, and a roller surface cleaning device controls a distance or pressure between the brush rollers and the casting roller by a position control device fixed on a casting roller bearing seat, which controls the flattening amount to be within 1-10 times of an average pit depth of a casting roller face.

6 Claims, 3 Drawing Sheets

(58) Field of Classification Search
USPC ..... 164/480, 428, 158, 154.5; 15/256.52
See application file for complete search history.

(56) References Cited

FOREIGN PATENT DOCUMENTS

| | | |
|---|---|---|
| JP | 3230849 | 10/1991 |
| JP | 9029393 | 2/1997 |
| KR | 100899706 | 5/2009 |

* cited by examiner

METHOD AND DEVICE FOR CLEANING A SURFACE OF A TWIN-ROLLER CONTINUOUS THIN STRIP CASTING ROLLER

CROSS-REFERENCE TO RELATED APPLICATIONS

This application claims priority to and benefit of PCT Application No. PCT/CN2012/001313, entitled "Method and Apparatus for Cleaning a Surface of a Twin-Roller Continuous Thin Strip Casting Roller," filed Sep. 27, 2012, which claims the benefit of Chinese Patent Application No. 201210362387.6 filed on Sep. 25, 2012, which are both incorporated herein by reference in their entirety.

TECHNICAL FIELD

The present invention relates to a casting technology, which specially relates to a method and apparatus for cleaning a surface of a twin-roller thin-belt continuous casting roller.

BACKGROUND

Twin-roller thin-belt continuous casting technology is different from traditional continuous casting technology, it directly pours molten steel into a molten pool circled by a side block panel and two relatively rotating casting rollers which can be quickly cooled; the molten steel is cooled and coagulated on a rotating circumferential surface of the casting roller so as to form a coagulated shell and gradually grow, and then be squeezed together at a position where the gap between two casting rollers is minimum, finally forming a thick metal thin-belt material at a belt outlet, and the belt material is transported to a curling machine for curling after 1-2 hot rolling procedures. The above method does not need a plurality of hot rolling procedures, it can greatly simplify the thin-belt production process and reduce the apparatus investment. Given that the metal coagulation time is short during the whole production process, grain refinement, material strength and toughness elongation of the thin-belt continuous casting product has been enhanced, and a quick coagulation speed is beneficial to restrain element segregation.

The twin-roller thin-belt continuous casting roller is made from copper alloy and coated by coating layer of chromium metal (Cr) or metallic nickel (Ni). The surface of the casting roller is brushed, and the brushed surface has a certain number of concaves or grooves. U.S. patent US20050126742 and WO200902704 and other patent documents disclose that the roller surface is regularly distributed with concaves or grooves having a certain depth and height after a certain processing to the roller surface, and after the molten steel contacts with the projections and coagulates, it is conductive to improve the quality of the casting belt, which reduces the quality defects of the casting belt surface caused by an uneven coagulation of the molten steel on the casting belt surface in the molten pool.

As the molten steel is cooled on the casting roller surface with a quick speed, while plenty of metal oxide or non-metal oxide impurities will precipitate and bond on the casting roller surface, if the metal oxide precipitation distribute unevenly, it will affect local heat conductivity strength of the casting roller surface, which will further cause the generation of cracks on the casting belt surface and causes quality defects of the casting belt surface. As one of the key technologies to ensure the casting belt quality, the twin-roller thin-belt continuous casting machine uses the brush roller to clean the roller surface. The brush roller has various forms and has different methods applying on the casting roller surface, while they both aim to use the brush roller to clean the adhesion material particles on the casting roller.

Chinese patent CN200420107544.X discloses a roller surface cleaning device, which uses a metal scraper to press the roller surface so as to scrape residue on the roller surface, and a spring at the rear portion of the scraper is used to provide a tightening force. This method causes a great abrasion on the casting roller surface and cannot clean tiny metal oxide on the roller surface due to structural restriction.

In addition, U.S. Pat. No. 5,307,861 discloses a method to horizontally arrange a row of brushes on the casting roller surface, the rotation of the casting roller can make the brushes moving axially, both of them forms relative movement to achieve an effect of cleaning the roller surface.

There are some other technical solutions disclosed in many patents relating to cleaning a surface of thin-belt continuous casting roller and all of them apply a technical solution that the roller surface cleaning device and the casting machine work independently with respect to each other. Although the structure as above is relatively simple, and it is relatively easy to control two devices, it is not easy to control a relative distance between the surface of the brush roller of the cleaning device and the surface of the casting roller. Once a time difference has appeared during the operating process of these two executing mechanisms, it will directly cause an uneven cleaning quality to the roller surface, which will further cause quality defects of the casting belt surface. And during the cleaning process of the roller surface, the brush hair of the cleaning device will be bended under the pressure, so a bending amount of the brush hair of the brush roller should match with a concave depth of the surface of the casting roller, so as to improve cleaning effect.

SUMMARY

An object of present invention is to provide a method and device for cleaning a surface of a twin-roller thin-belt continuous casting roller. During the twin-roller continuous thin-belt casting process, the present invention uses a reasonable cleaning method and device to improve cleaning effect of the thin-belt continuous casting roller and make the thermal conductivity coefficient of the roller surface to be uniform while improve the quality of the casting belt. The present invention is adapted to a twin-roller thin-belt casting continuous machine of which a casting thickness of the metal belt is 1.5-5 mm.

In order to achieve the above object, the technical solution of the present invention is:

A method for cleaning a surface of a twin-roller thin-belt continuous casting roller, wherein each casting roller of the twin-roller continuous thin-belt casting machine comprises two brush rollers in an upper and lower arrangement for cleaning the surface thereof, wherein a rotational direction of at least one brush roller is the same as the casting roller, and a linear speed of the casting roller is constant and greater than a rotational speed of the casting roller, and a roller surface cleaning device controls a distance or a pressure between the brush rollers and the casting roller by means of a position control device fixed on a casting roller bearing seat; at the beginning of casting, the brush roller is moving close to the surface of the casting roller and starts cleaning, as casting is processed, the roller surface cleaning device conducts relative displacement adjustment according to an expanding amount of the casting roller to keep a constant pressure between the brush roller and the casting roller; during the roller surface cleaning process, brush hair of the brush roller is pressed to be bent on the roller surface of the casting roller under an action of the position control device, the brush roller is shown to be partly flattened in macrocosm, a minimum flattening amount of the brush roller is a difference between a brush roller diameter r and a minimum diameter $r_{min}$ after flattening, that is: the flattening amount $\Delta r = r - r_{min}$, unit: mm, the flattening amount is among 1-10 times of an average pit depth of a brushed roller surface of the casting roller, that is: $\Delta r \leq (1-10) \cdot Rc$, and the average pit depth of the roller surface is measured by an average linear height $R_c$ of a roller surface contour unit; (the definition of $R_c$ is achieved from <<Handbook of Mechanical Design>>, Mechanical Industry Press, 2000, P 23-307).

Before casting the upper and lower brush rollers move close to the roller surface simultaneously and rotate, wherein a rotating speed of the lower brush roller is 0.2-0.5 time of that of the upper brush roller, and a rotating speed of the upper brush roller is 1.5-3 times of that of the casting roller, and a pressure applied on the roller surface by the lower brush roller is 1-2 times larger than that of the upper brush roller; During a stable casting phase, the lower brush roller separates from the casting roller surface and keeps an interval of 0.1-1 mm therebetween; the rotating speed of the upper brush roller is 1.5-3 times of that of the casting roller. the casting operation is to be over, a delivery system stops supplying molten steel, the lower brush roller gets close to the roller surface and rotates, while the rotating speed of the lower brush roller is 0.2-0.5 time of that of the upper brush roller, the rotating speed of the upper brush roller is 1.5-3 times of that of the casting roller, and the pressure applied on the roller surface by the lower brush roller is 1-2 times of the pressure applied on the roller surface by the upper brush roller; a unit pressure applied on the casting roller by the upper brush roller is 0.1-2.5 MPa.

Further, the upper brush roller of the brush rollers has a brush hair of which diameter is thinner and longer than that of the lower brush roller, a brush diameter of the upper brush roller is Φ0.06-Φ0.28 mm, that of the lower brush roller is Φ0.2-Φ0.4 mm; a brush hair length of the lower brush roller is 20-50 mm, and that of the upper brush roller is 40-60 mm.

The brush hair length on same brush roller is equal length or unequal length, and density of the brush hair distributed on the whole roller body of the brush roller is consistent.

Moreover, the brush hair of the brush roller uses copper wire or stainless steel wire.

The apparatus for cleaning a surface of a twin-roller thin-belt continuous casting roller of the present invention, which includes, each casting roller is provided with two upper and lower brush rollers, respectively, the brush roller has a length greater than that of the casting roller surface, two brush rollers are mounted at the outer side of the casting roller, both of the brush roller axes are parallel to the casting roller axis, an inner side of the casting roller faces to a molten pool, the upper and lower brush roller are symmetrically arranged at the upper and lower sides of the casting roller rotational center line; a bearing seat supporting both ends of the brush roller is connected to the bearing seat of the casting roller though the a position control device, and one end of the brush roller is connected with a speed reducer and a motor; a position control device of the brush roller is provided with a displacement sensor therein for monitoring a distance between the brush roller and the casting roller surface and further controlling the pressure applied on the brush hair, the displacement sensor is electrically connected with the thin-belt continuous casting control system. The speed of two brush rollers with respect to the casting roller surface can be controlled respectively.

The upper brush roller of the brush rollers has a brush hair of which diameter thinner and longer than that of the lower brush roller, the brush hair diameter of the upper brush roller is Φ0.06-Φ0.28 mm; the brush hair length of the lower brush roller is 20-50 mm, and that of the upper brush roller is 40-60 mm.

The brush hair length on same brush roller is equal length or unequal length; and density of the brush hair distributed on the whole roller body of the brush roller is consistent, so as to maintain the cleaning effect of the brush roller.

The brush hair of the brush roller uses copper wire or stainless steel wire.

Each casting roller of the twin-roller thin-belt continuous casting machine uses two brush rollers to clean the surface thereof, wherein a rotational direction of at least one brush roller is the same as the casting roller, a linear speed of the casting roller is constant and greater than a rotational speed of the casting roller, and a roller surface cleaning device controls a distance or a pressure between the brush rollers and the casting roller by means of a position control device fixed on a casting roller bearing seat. The casting roller is manufactured by copper allay and is coated with a coating layer of chromium metal (Cr) or metallic nickel (Ni), the surface of the casting roller is brushed, the brushed surface has regularly distributed concaves and grooves with a certain depth and height. After the molten steel contacts with the projections and coagulates, it is conductive to improve the quality of the casting belt, which reduces the quality defects of the casting belt surface caused by an uneven coagulation of the molten steel on the casting belt surface in the molten pool.

At the beginning of casting, the brush roller is close to the surface of the casting roller and starts cleaning, as casting is processed, the roller surface cleaning device conducts relative displacement adjustment according to a expanding amount of the casting roller to keep a constant pressure between the brush roller and the casting roller; with shortening of the brush hair of the brush roller, the pressure applied on the casting roller thereby gradually reduces, while a rotational angle speed of the brush roller increases correspondingly. A proper brush hair of the brush roller of the roller surface cleaning device is selected in accordance with the brushed form and appearance of the roller surface, and a rotational speed of the brush roller and a diameter of the brush hair on the same side are different, applied strategy during the casing process is also different. Here is the specific explanation.

The twin-roller thin-belt continuous casting technology means to directly pour molten steel into a molten pool circled by two relatively rotating casting rollers which can be quickly cooled and a side block panel by a delivery system, the molten steel is cooled and coagulated on a rotating circumferential surface of the casting roller so as to form a coagulated shell and gradually grow and then be squeezed together at a position where the gap between two casting rollers in minimum, finally forming a thick metal thin-belt material at a belt outlet, and the belt material is sent to a curling machine for curling after 1-2 hot rolling procedures.

The casting roller is manufactured by copper allay and is coated with a coating layer of chromium metal (Cr) or metallic nickel (Ni), the roller surface is brushed, the brushed surface has regularly distributed concaves and grooves with a certain depth and height. After the molten steel contacts with the projections and coagulates, it is conductive to improve the quality of the casting belt, which reduces the quality defects of the casting belt surface caused by an uneven coagulation of the molten steel on the casting belt surface in the molten pool.

In the method according to present invention, each casting roller of the casting machine comprises two brush rollers to clean the surface thereof, wherein a rotational direction of at least one brush roller is the same as the casting roller. As casting is processed, the roller surface cleaning device conducts relative displacement adjustment according to a expanding amount of the casting roller to keep a cleaning effect of the casting roller surface; during a process of cleaning the roller surface, the brush hair of the brush roller is shortened gradually, under the function of the position control device, a pressure applied on the casting roller by the brush roller will be constant, and a built-in displacement sensor of the brush roller position control device of the brush roller records an abrasion amount of the brush hair and feed it back to a casting machine control system. The latter will send an instruction to change the angle speed of the brush roller, so as to maintain the linear speed of the outer circumference of the brush roller to be uniform.

During the roller surface cleaning process, brush hair of the brush roller is pressed to be bent on the roller surface of the casting roller under an action of the position control device, the brush roller is shown to be partly flattened in macrocosm, a minimum flattening amount of the brush roller is a difference between a brush roller diameter r and a minimum diameter $r_{min}$ after flattening, that is: the flattening amount $\Delta r = r - r_{min}$, the flattening amount is among 1-10 times of an average pit depth of a brushed roller surface of the casting roller, that is: $\Delta r \leq (1-10) \cdot R_c$, and the average pit depth of the roller surface is measured by an average linear height $R_c$ of a roller surface contour unit;

Before casting operation starts, the upper and lower brush rollers of the roller surface cleaning device get close to the roller surface simultaneously and rotate, a rotating speed of the lower brush roller is 0.2-0.5 time of that of the upper brush roller, a rotating speed of the upper brush roller is 1.5-3 times of that of the casting roller, and a pressure applied on the roller surface by the lower brush roller is 1-2 times larger than that of the upper brush roller;

During a stable casting phase, the lower brush roller of the roller surface cleaning device separates from the contacting with the casting roller surface and keeps an constant interval of 0.1-1 mm therebetween; the rotating speed of the upper brush roller is 1.5-3 times of that of the casting roller;

When the casting operation is to be over, a delivery system stops supplying molten steel, the lower brush roller of the roller surface cleaning device gets close to the roller surface and rotates, while the rotating speed of the lower brush roller is 0.2-0.5 time of that of the upper brush roller, the rotating speed of the upper brush roller is 1.5-3 times of that of the casting roller, and the pressure applied on the roller surface by the lower brush roller is 1-2 times of the pressure applied on the roller surface by the upper brush roller; a unit pressure applied on the casting roller by the upper brush roller is 0.1-2.5 MPa.

The definition of the stable casting phase is the casting process after 1-7 minutes after casting, each parameter of the thin-belt continuous casting machine maintains stable.

Main Advantages of the Present Invention

1. Providing a constant cleaning effect by maintaining a same linear speed in accordance with a diameter change of the cleaning roller; both of the rotational speed and direction of the upper and lower brush rollers at the same side will change, which can improve the cleaning effect by cooperating use.

2. A relative mounting position between the brush roller and the casting roller is fixed relatively, and the controlling reference is uniform.

3. By selecting the brush roller in accordance with a brushed condition of the casting roller surface, improving cleaning quality of the roller surface and cleaning efficiency, and reducing abrasion of the casting roller and the roller brush.

EMBODIMENTS

Figure 1:
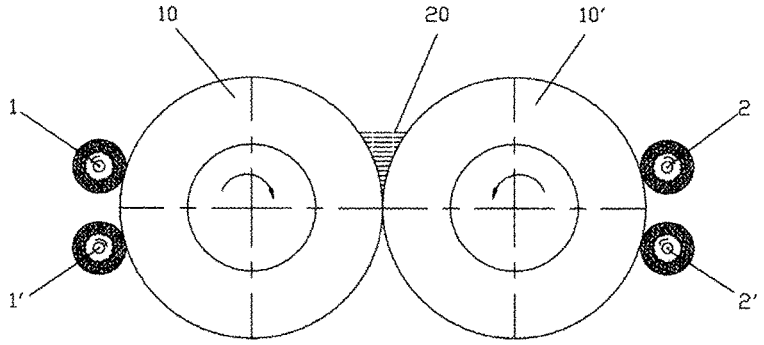
FIG. 1 is a schematic diagram of cleaning the surface of the thin-belt continuous casting roller of the present invention.

As shown in FIGS. 1-4, the method for cleaning a surface of a twin-roller thin-belt continuous casting roller of the present invention, each casting roller 10, 10' of the twin-roller thin-belt continuous casting machine comprises two brush rollers 1, 1', 2, 2' arranged at the top and bottom, of which the rotational direction is opposite to that of the casting roller, for cleaning the surface thereof, a linear speed of the casting roller is constant and greater than a rotational speed of the casting roller, and a roller surface cleaning device controls a distance or a pressure between the brush rollers and the casting roller by means of a position control device fixed on a casting roller bearing seat;

At the beginning of casting, the brush roller is close to the surface of the casting roller and starts cleaning, as casting is processed, the roller surface cleaning device conducts relative displacement adjustment according to a expanding amount of the casting roller to keep a constant pressure between the brush roller and the casting roller;

During the roller surface cleaning process, brush hair of the brush roller is pressed to be bent on the roller surface of the casting roller under an action of the position control device, the brush roller is shown to be partly flattened in macrocosm, a minimum flattening amount of the brush roller is a difference between a brush roller diameter r and a minimum diameter $r_{min}$ after flattening, that is: the flattening amount $\Delta r = r - r_{min}$, unit: mm, the flattening amount is among 1-10 times of an average pit depth of a brushed roller surface of the casting roller, that is: $\Delta r \leq (1-10) \cdot R_c$, and the average pit depth of the roller surface is measured by an average linear height $R_c$ of a roller surface contour unit;

Before casting operation starts, the upper and lower brush rollers get close to the roller surface simultaneously and rotate, a rotating speed of the lower brush roller is 0.2-0.5 time of that of the upper brush roller, a rotating speed of the upper brush roller is 1.5-3 times of that of the casting roller, and a pressure applied on the roller surface by the lower brush roller is 1-2 times larger than that of the upper brush roller; During a stable casting phase, the lower brush roller separates from the contacting with the casting roller surface and keeps an interval of 0.1-1 mm therebetween; the rotating speed of the upper brush roller is 1.5-3 times of that of the casting roller.

When the casting operation is to be finished, a delivery system stops supplying molten steel, the lower brush roller gets close to the roller surface and rotates, while the rotating speed of the lower brush roller is 0.2-0.5 time of that of the upper brush roller, the rotating speed of the upper brush roller is 1.5-3 times of that of the casting roller, and the pressure applied on the roller surface by the lower brush roller is 1-2 times of the pressure applied on the roller surface by the upper brush roller; a unit pressure applied on the casting roller by the upper brush roller is 0.1-2.5 MPa.

Furthermore, the upper brush roller of the brush rollers has a brush hair of which diameter thinner and longer than that of the lower brush roller, the brush hair diameter of the upper brush roller is Φ0.06-Φ0.28 mm, while the brush hair diameter of the lower brush roller is Φ0.2-Φ0.4 mm; the brush hair length of the lower brush roller is 20-50 mm, and that of the upper brush roller is 40-60 mm.

The brush hair length on same brush roller is equal length or unequal length, and density of the brush hair distributed on the whole roller body of the brush roller is consistent. The brush hair of the brush roller uses copper wire or stainless steel wire.

Figure 2:
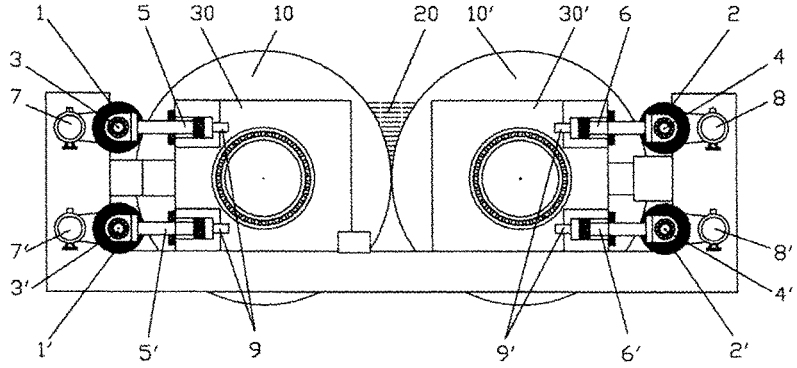
FIG. 2 is a structural diagram of the roller surface cleaning device of the present invention.
Figure 3:
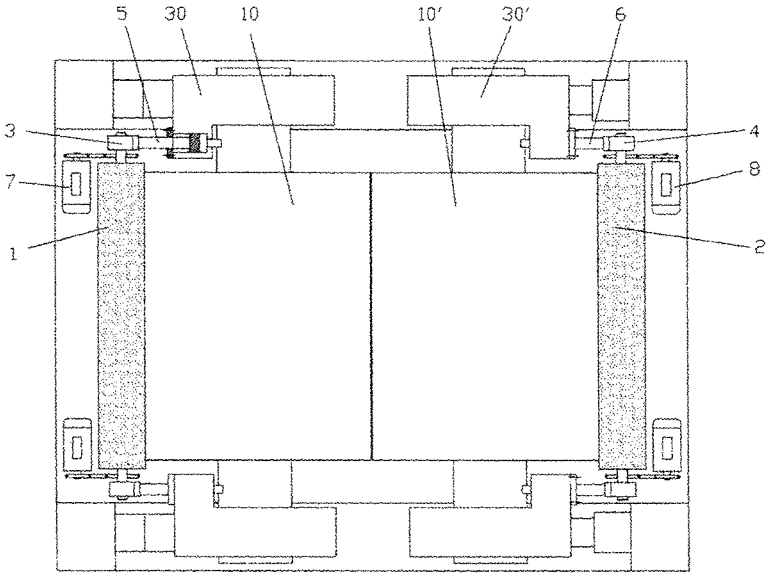
FIG. 3 is a top view of FIG. 2.
Figure 4:
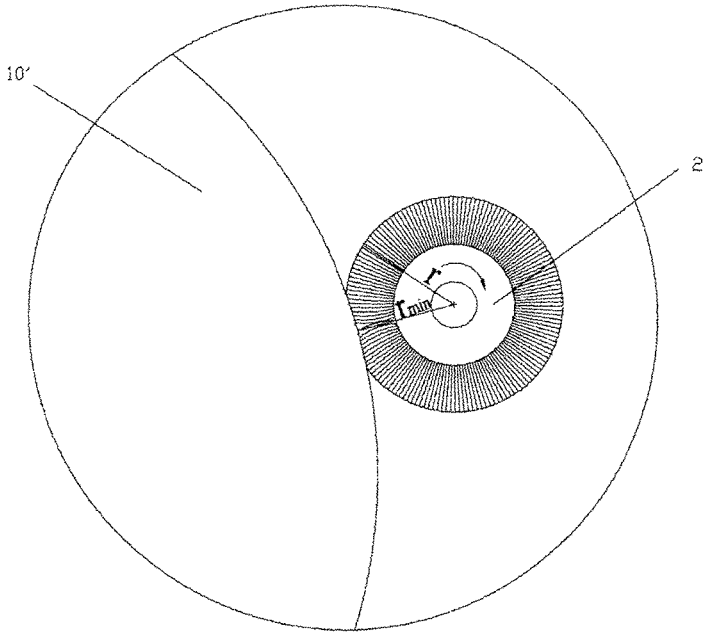
FIG. 4 is a calculative diagram of a flattening amount of the roller brush of the present invention.

As shown in FIGS. 1-3, the apparatus for cleaning a surface of a twin-roller thin-belt continuous casting roller of the present invention, which comprising: each casting roller 10, 10' is provided with two upper and lower brush rollers 1, 1', 2, 2', respectively, the brush roller has a length greater than that of the casting roller surface, two brush rollers are mounted at the outer side of the casting roller 10, 10', both of the brush roller axes are parallel to the casting roller axis, an inner side of the casting roller faces to a molten pool 20, the upper and lower brush roller 1, 1', 2, 2' are symmetrically arranged at the upper and lower sides of the rotational center line of the casting roller 10, 10'; bearing seats 3, 3', 4, 4' supporting both ends of the brush roller 1, 1', 2, 2' is connected to the bearing seat 30, 30' of the casting roller 10, 10' though a hydraulic drive cylinder 5, 5', 6, 6', and one end of the brush roller 1, 1', 2, 2' is connected with a speed reducer 7, 7' and a motor 8, 8'; and the hydraulic drive cylinder of the brush rollers is provided with displacement sensors 9, 9' therein, the displacement sensor is electrically connected to the thin-belt continuous casting control system.

The invention claimed is:

1. A method for cleaning a roller surface of a twin-roller thin-belt continuous casting roller, wherein the casting roller comprises an upper brush roller and a lower brush roller in an arrangement for cleaning the roller surface thereof, wherein a rotational direction of at least one brush roller is the same as the casting roller; a linear speed of the casting roller is constant and greater than a rotational speed of the casting roller; and a roller surface cleaning device controls a distance or a pressure between the brush rollers and the casting roller by a position control device fixed on a casting roller bearing seat, the method comprising:

before casting, moving the upper brush rollers and lower brush rollers adjacent to the roller surface simultaneously and rotating the upper brush rollers and lower brush rollers, wherein a rotating speed of the lower brush roller is 0.2-0.5 times of that of the upper brush roller, and a rotating speed of the upper brush roller is 1.5-3 times of that of the casting roller; and a pressure applied on the roller surface by the lower brush roller is 1-2 times of that of the upper brush roller;

during a stable casting phase, moving the lower brush roller away from the casting roller surface to maintain an interval of 0.1-1 mm therebetween; wherein rotating speed of the upper brush roller is 1.5-3 times of that of the casting roller;

in the end of a casting operation, moving the lower brush roller adjacent to the roller surface and rotating the lower brush roller, wherein the rotating speed of the lower brush roller is 0.2-0.5 times of that of the upper brush roller, and rotating speed of the upper brush roller is 1.5-3 times of that of the casting roller, and pressure applied on the roller surface by the lower brush roller is 1-2 times of pressure applied on the roller surface by the upper brush roller; and a unit pressure applied on the casting roller by the upper brush roller is 0.1-2.5 MPa.

2. The method according to claim 1, wherein during casting, the roller surface cleaning device conducts corresponding displacement adjustment according to an expanding amount of the casting roller to maintain constant pressure between the brush roller and the casting roller.

3. The method according to claim 1, wherein brush hair of the upper brush roller is thinner and longer than that of the lower brush roller, and a maximum brush hair diameter of the lower brush roller and upper brush roller is less than an average diameter of a half times of a roller surface pit.

4. The method according to claim 1, wherein during casting, the roller surface cleaning device conducts corresponding displacement adjustment according to an expanding amount of the casting roller and an attrition of brush hair to maintain a pressure on the casting roller to be constant; during cleaning the roller surface, the brush hair is shortened gradually, a built-in displacement sensor of an associated brush roller position control device records an abrasion amount of the brush hair and feeds it back to a casting machine control system, and the casting machine control system sends out an instruction to change angle speed of the upper brush roller or the lower brush roller to keep a constant linear speed of an outer circumference of the upper brush roller or the lower brush roller.

5. The method according to claim 1, wherein brush hair of the lower brush roller and upper brush roller are equal, and density of the brush hair distributed on the lower brush roller and upper brush roller is consistent.

6. The method according to the claim 1, wherein brush hair of the brush roller is copper wire or stainless steel wire.

* * * * *